United States Patent [19]

Ishii

[11] 4,286,259

[45] Aug. 25, 1981

[54] ELECTRICALLY OPERATED BELL

[75] Inventor: Tadashi Ishii, Tokyo, Japan

[73] Assignee: Kobishi Electric Co., Ltd., Tokyo, Japan

[21] Appl. No.: 169,605

[22] Filed: Jul. 17, 1980

[51] Int. Cl.[3] ..... G10K 1/064; G08B 3/10

[52] U.S. Cl. ..... 340/396; 340/399; 340/402

[58] Field of Search ..... 340/396, 399, 402; 310/80; 116/152, 154, 155

[56] References Cited

U.S. PATENT DOCUMENTS 4,183,018 1/1980 Sakaguchi ..... 340/396

*Primary Examiner*—Harold I. Pitts

*Attorney, Agent, or Firm*—Darby & Darby

[57] ABSTRACT

An electrically operated bell comprises an electric drive means and a pivotal lever supporting a hammer means. The lever is operatively connected to the drive means for intermittently moving the hammer means into striking contact with a gong. The lever has a pivot adjusting means by which the fulcrum of the pivotal lever can be varied.

5 Claims, 8 Drawing Figures

ELECTRICALLY OPERATED BELL

BACKGROUND OF THE INVENTION

1 Field of the Invention

This invention relates to electrically operated bells of the type in which a motor or an electromagnet drives a hammer through a transmission means to allow the hammer to strike against an associated gong to produce bell sound.

2 Prior Art

There are known various electrically operated bells which produce bell sound of different volume depending on the purpose for which they are used. In the manufacture of bells which produce bell sound of different volume, it has been necessary to use different component parts. Naturally, this increases the manufacturing cost where it is desired to manufacture bells which produce bell sound of different volume.

SUMMARY OF THE INVENTION

It is therefore an object of this invention to provide an electrically operated bell in which the bell sound to be produced is adjusted to a desired preselected volume without exchanging component parts when assembling the bell.

According to the invention, there is provided an electrically operated bell which comprises a base; a gong mounted on the base; an electric drive means; a hammer means for striking against the gong; and a lever pivotally mounted on the base and supporting the hammer means, the lever being operatively connected to the drive means for intermittently moving the hammer into striking contact with the gong, and the lever having a pivot adjusting means by which the fulcrum of the pivotal lever can be varied.

Other advantages, features and additional objects of the present invention will become manifest to those versed in the art upon making reference to the detailed description and the accompanying sheets of drawings in which preferred embodiments incorporating the principles of the present invention are shown by way of illustrative examples.

DESCRIPTION OF THE PREFERRED EMBODIMENTS

Figure 1:
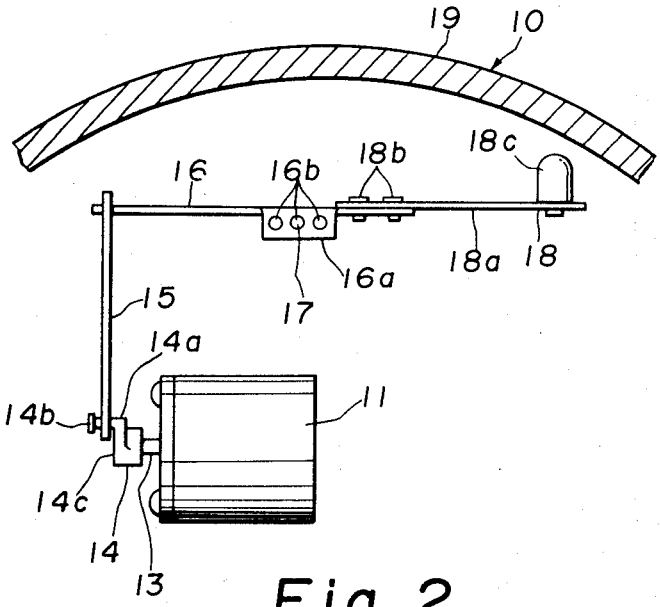
FIG. 1 is a schematic plan view of a motor actuated bell constructed in accordance with the present invention.
Figure 2:
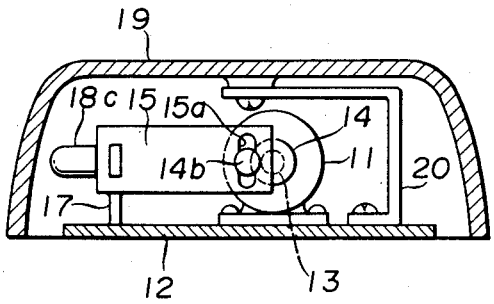
FIG. 2 is a cross-sectional view of the bell.

FIGS. 1 and 2 show a motor actuated bell 10 which comprises an electric motor 11 mounted on a mounting plate or base 12 and having a rotatable drive shaft 13. A crank member 14 is fixedly mounted on the drive shaft 13 for rotation therewith and having an integral pin **14*a* disposed in eccentric or offset relation to the axis of the drive shaft 13. An elongated connecting plate 15 of a rectangular shape has a slot 15*a* formed therethrough at one end thereof and extending widthwise, i.e., perpendicular to its longitudinal axis. The eccentric pin 14*a* is loosely fitted in the slot 15*a* and has an enlarged head 14*b* for preventing the connecting plate 15** from becoming disengaged therefrom.

A rigid lever 16 is pivotally mounted intermediate its opposite ends on a pivot pin 17 extending from the mounting plate 12. The lever 16 is rigidly connected at one end thereof to the end of the connecting plate 15 remote from the eccentric pin **14*a*, the lever 16 extending through the connecting plate 15** and intersecting the same substantially perpendicularly.

A hammer means 18 comprises a leaf spring **18*a* secured at one end thereof by rivets 18*b* to the end of the lever 16 remote from the connecting plate 15, and a hammer element 18*c* secured to the other end of the leaf spring 18*a***.

As shown in FIG. 1, the length of the eccentric pin **14*a* between the inner face of the head 14*b* and the end face 14*c* of the crank member 14 is greater than the thickness of the connecting plate 15 to permit a slight lateral movement of the plate 15**.

According to an important aspect of the present invention, the fulcrum or the axis of pivotal movement of the lever 16 is preselected to impart a desired momentum to the hammer element **18*c*. To this end, the lever 16 has a pivot adjusting portion 16*a* in the form of an integral lug having three apertures 16*b* spaced along the length of the lever 16, the lug 16*a* being disposed intermediate the opposite ends of the lever. The pin 17 is adapted to be received in any one of the three apertures 16*b* depending on the desired momentum to be imparted to the hammer element 18*c*. When it is desired to produce bell sound of the maximum volume, the pin 17 is received in the left-hand aperture 16*b***.

As shown in FIG. 2, the mounting plate 12 is arranged within and connected to an inverted cup-shaped gong or bell 19 by a connecting member 20 of a generally channel-shaped cross-section.

In operation, the motor 11 is first driven through a power source (not shown) to rotate the crank member 14 in a clockwise direction (FIG. 2) to allow the eccentric pin **14*a* to revolve around the drive shaft 13 so that the connecting plate 15 is reciprocally moved along its longitudinal axis. The thus moved connecting plate 15 allows the lever 16 to pivot about the pin 17 to impart a swinging motion to the hammer means 18 so that the hammer element 18*c* is caused to intermittently strike against the inner wall of the gong 19** to produce bell sound.

Figure 3:
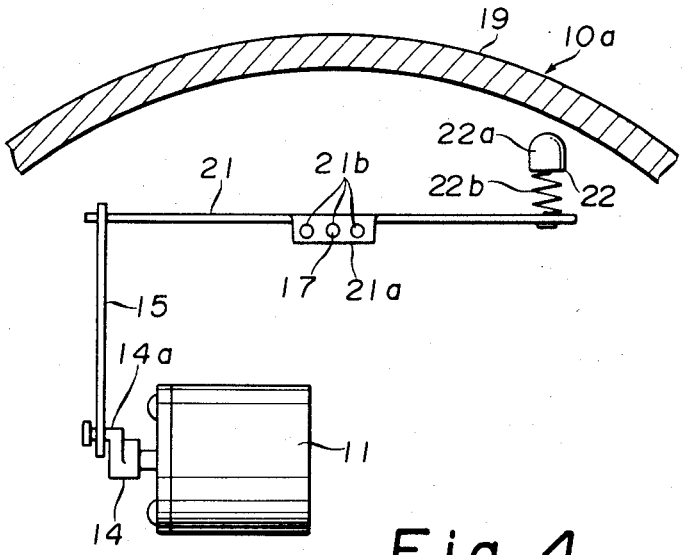
FIGS. 3 to 6 are views similar to FIG. 1 but showing modified motor actuated bells.

According to a second embodiment of the invention in FIG. 3, a rigid lever 21 is pivotally mounted on the pin 17 intermediate opposite ends thereof. The lever 21 has a hammer means 22 secured to its free end remote from the connecting plate 15, the hammer means comprising a hammer element **22*a* and a resilient means 22*b* in the form of a coil spring interconnecting the hammer element 22*a* and the lever 21. The lever 21 has a pivot adjusting portion 21*a* in the form of an integral lug identical in construction to the lug 16*a* of the lever 16 in the preceding embodiment of the invention shown in FIGS. 1 and 2. The pin 17 is adapted to be received in any one of spaced three apertures 21*b* depending on the desired momentum to be imparted to the hammer element 22*a*. A mode of operation of this bell 10*a* is substantially similar to that of the bell 10 shown in FIGS. 1 and 2**.

Figure 4:
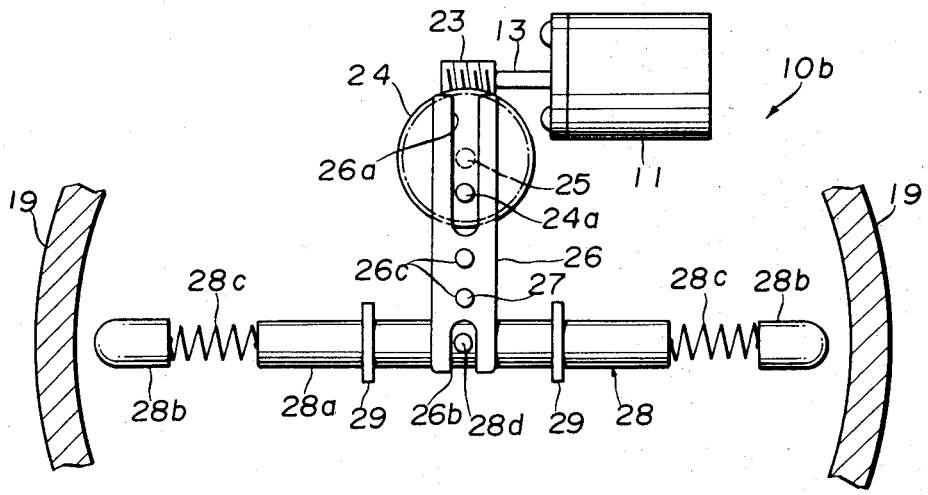

FIG. 4 shows a motor actuated bell 10*b* in accordance with a third embodiment of the invention. A worm gear 23 is fixedly mounted on the drive shaft 13 of the motor 11 for rotation therewith. A worm wheel 24 is rotatably mounted at its center on a post 25 extending from the mounting plate 12, the worm wheel having a pin 24*a* eccentric from its axis and hence the axis of the post 25. The worm gear 23 is in meshing engagement with the periphery of the worm wheel 24. A lever 26 of a generally rectangular shape has a longitudinal slot 26*a* formed therethrough and extending from a point approximately centrally of its length to its one end, and another slot 26*b* is formed through the other end of the lever 26.

The lever 26 is pivotally mounted on a pin 27 extending from the mounting plate 12 and has a pivot adjusting means in the form of a pair of apertures 26*c* formed therethrough between the slots 26*a*, 26*b*.

A hammer means 28 has an elongated body 28*a* extending through a pair of stamped-out portions 29, 29 of the mounting plate 12 for sliding movement along its longitudinal axis, the hammer means 28 having a pair of hammer elements 28*b*, 28*b* at its opposite ends and a pair of coil springs 28*c*, 28*c* each extending between the respective end of the hammer body 28*a* and the hammer element 28*c*. The hammer body 28*a* extends substantially perpendicular to the lever 26 and has an integral pin 28*d* disposed centrally of its length and between the pair of the stamped-out portions 29, 29. The eccentric pin 24*a* is loosely received in the slot 26*a* while the pin 28*d* is loosely received in the slot 26*b*.

The pin 27 is adapted to be received in one of the apertures 26*c* depending on the desired momentum to be imparted to the hammer elements 28*b*, 28*b*.

In operation, the motor 11 is driven to rotate the worm wheel 24 in one direction so that the lever 26 is pivoted about the pin 27 in opposite directions to allow the pair of hammer elements 28*b*, 28*b* to strike against the gong 19 in an alternate fashion to produce bell sound.

Figure 5:
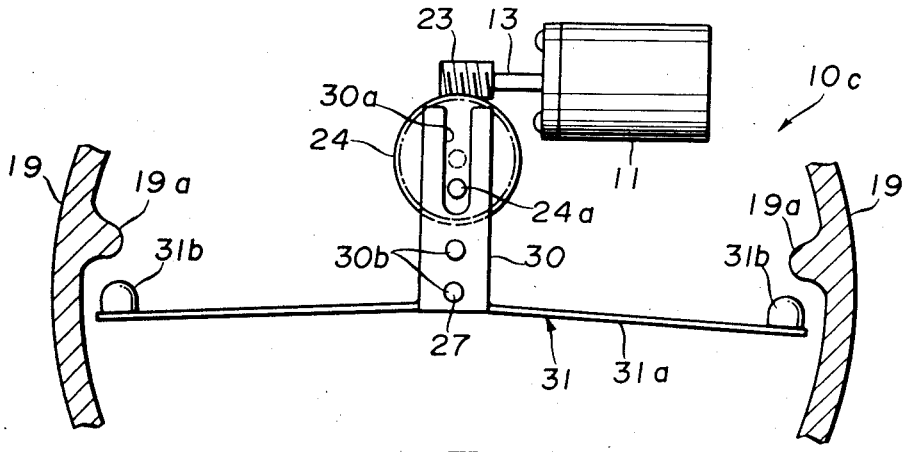

FIG. 5 shows a forth embodiment of the invention. A motor actuated bell 10*c* in this embodiment deffers from the bell shown in FIG. 4 in that modified lever and hammer means are provided. The lever 30 has at one end portion a longitudinal slot 30*a* in which the eccentric pin 24*a* is loosely received, the lever being pivotally mounted on the pin 27. The lever 30 has a pivot adjusting means in the form of a pair of apertures 30*b*. The hammer means 31 comprises a generally straight arm 31*a* fixedly secured to the end of the lever 30 remote from the slot 30*a* intermediate its opposite ends, and a pair of hammer elements 31*b*, 31*b* secured to the opposite ends of the arm 31*a*, respectively. The arm 31*a* is disposed generally perpendicular to the lever 30. The pin 27 is adapted to be received in one of the apertures 30*b*, 30*b* depending on the desired momentum to be imparted to the hammer elements 31*b*, and 31*b*.

In operation, the motor 11 is first driven to rotate the worm wheel 24 through the drive shaft 13 and the worm gear 23 so that the lever 30 is pivoted about the pin 27 to allow the hammer elements 31*b*, 31*b* to strike against gong projections 19*a*, 19*a*, respectively in an alternate fashion to produce bell sound.

Figure 6:
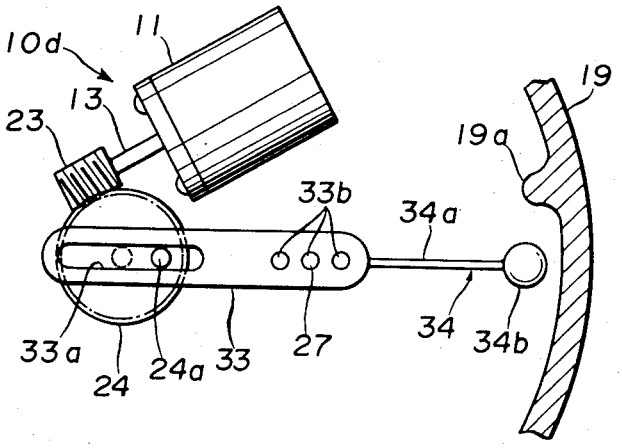

FIG. 6 shows a fifth embodiment of the invention. A motor actuated bell 10*d* in this embodiment generally differs from the bell shown in FIG. 4 in that modified lever and hammer means are provided. The lever 33 has a rectangular configuration with rounded opposite ends, the lever having a longitudinal slot 33*a* formed therethrough at its left-hand portion in which slot the eccentric pin 24*a* is loosely received. The lever 33 is pivotally mounted on the pin 27. A hammer means 34 comprises an arm 34*a* secured at its one end to the end of the lever 33 remote from the slot 33*a*, and a hammer element 34*b* secured to the other end of the arm 34*a*, the arm 34*a* lying in a longitudinal axis of the lever 33. The lever 33 has a pivot adjusting means in the form of three longitudinally spaced apertures 33*b*. The pin 27 is adapted to be received in any one of the apertures 33*b* depending on the desired momentum to be imparted to the hammer element 34*b*.

In operation, the motor is driven to rotate the worm wheel 24 so that the lever 33 is pivoted about the pin 27 to allow the hammer element 34*b* to strike against the gong projection to produce bell sound.

Figure 7:
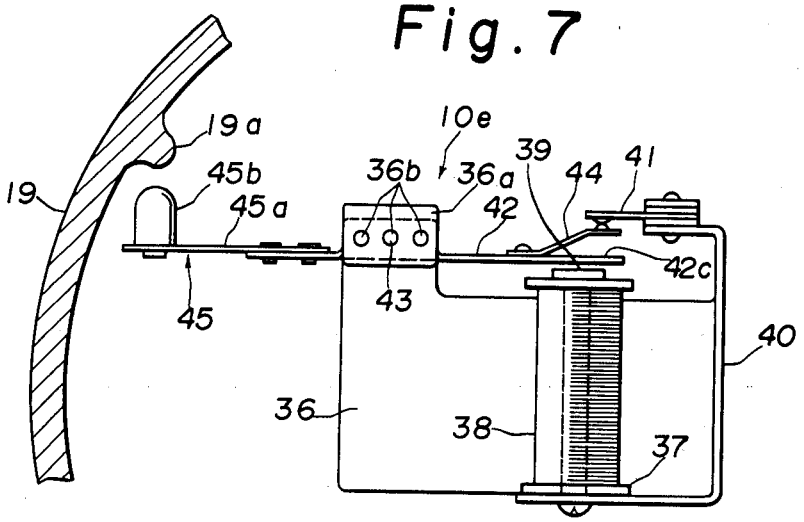
FIG. 7 is a schematic plan view of an electromagnetically actuated bell constructed in accordance with the present invention.
Figure 8:
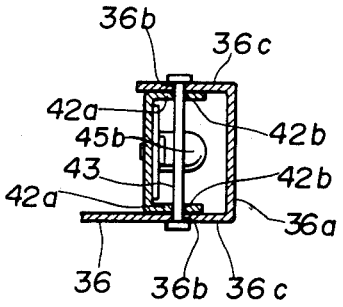
FIG. 8 is a cross-sectional view of the electromagnetically actuated bell.

FIGS. 7 and 8 show a sixth embodiment of the invention. An electromagnetically actuated bell 10*e* comprises frame 36 and a bobbin 37 mounted on the frame 36. A coil 38 is wound around the bobbin 37, and a core 39 is inserted in the bobbin 37. A mounting plate 40 of a generally U-shape is secured at its one end to the bobbin 37 and has a first contact plate 41 secured to the other end . As best shown in FIG. 8, the frame 36 has a mounting portion 36*a* of a channel-shaped cross-section having three pairs of aligned apertures 36*b* extending through the opposed walls 36*c*, 36*c* respectively. A lever 42 comprises a rectangular plate having intermediate its opposite ends a pair of opposed integral mounting sections 42*a*, 42*a* having three pairs of aligned apertures 42*b*, the lever being made of a magnetic material such as iron. The lever 42 is mounted on the frame 36 with the mounting sections 42*a*, 42*a* received in the mounting portion 36*a* in such a manner that each pair of apertures 36*b* are in alignment with each pair of apertures 42*b* to provide three combinations of aligned apertures 36*b*, 42*b*. A pin 43 is adapted to be received in any one of the three combinations of aligned apertures 36*b*, 42*b* to provide a pivotal connection between the frame 36 and the lever 42. A second contact plate 44 is secured to one end portion of the lever 42 while a hammer means 45 is secured to the other end of the lever. The hammer means 45 comprises a leaf spring 45*a* secured to the lever 42 and a hammer element 45*b* secured to the leaf spring 45*a*. The coil 38 is electrically connected to the contact plate 44.

In operation, a DC voltage is first applied across the coil 38 and the contact 41. When current flows through the coil 38 and the engaged contact plates 44, 41, the core 39 is magnetized to attrack the end portion 42*c* of the lever 42 disposed in opposed relation thereto so that the lever 42 is pivoted about the pin 43, with the contact plate 44 moved away from the contact plate 41, to allow the hammer element 45*b* to strike against the gong projection 19*a* to produce bell sound. When the contact plate 44 is disengaged from the contact plate 41, the core 39 becomes demagnetized so that the hammer element 45*b* rebounds from the gong projection 19*a* to bring the contact plate 44 into engagement with the contact plate 41 to again magnetize the core 39. This cycle of operation is continuously repeated.

As described above, the bells according to the present invention are provided with the pivot adjusting means whereby the fulcrum or the axis of pivotal movement of the lever is preselected to impart a desired momentum to the hammer element depending on the required bell sound to be produced.

While the bells according to this invention have been specifically shown and described herein, the invention itself is not to be restricted by the exact showing of the drawings or the description thereof. For example, a speed reducer may be connected to the motor drive shaft to actuate the hammer at a lower speed.

What is claimed is:

1. An electrically operated bell which comprises:

(a) a base;

(b) a gong mounted on said base;

(c) an electric drive means mounted on said base;

(d) a hammer means for striking against said gong; and (e) a lever pivotally mounted on said base and supporting said hammer means, said lever being operatively connected to said drive means for intermittently moving said hammer means into striking contact with said gong, and said lever having a pivot adjusting means by which the fulcrum of said pivotal lever can be varied.

2. A bell according to claim 1, further including a pivot pin mounted on said base, said pivot adjusting means being a plurality of apertures formed in said lever, and said pivot pin being received in any one of said apertures.

3. A bell according to claim 1, in which said drive means comprises an electric motor having a rotatable drive shaft.

4. A bell according to claim 3, further including a transmission means connected between said motor drive shaft and said lever.

5. A bell according to claim 1, in which said drive means comprises an electromagnet for intermittently drawing said lever by an attractive force for pivoting the same.

* * * * *